US011186471B2

(12) United States Patent
Marchini

(10) Patent No.: US 11,186,471 B2
(45) Date of Patent: Nov. 30, 2021

(54) MANUAL CAPPER WITH TWO LEVER FOR CROWN CAPS

(71) Applicant: FERRARI GROUP S.R.L., Montechiarugolo (IT)

(72) Inventor: Francesco Marchini, Montechiarugolo (IT)

(73) Assignee: FERRARI GROUP S.R.L., Montechiarugolo (IT)

( * ) Notice: Subject to any disclaimer, the term of this patent is extended or adjusted under 35 U.S.C. 154(b) by 35 days.

(21) Appl. No.: 16/710,768

(22) Filed: Dec. 11, 2019

(65) Prior Publication Data

US 2020/0189893 A1 Jun. 18, 2020

(30) Foreign Application Priority Data

Dec. 12, 2018 (IT) ..... 102018000011020

(51) Int. Cl.
*B67B 3/12* (2006.01)
*B67B 3/14* (2006.01)

(52) U.S. Cl.
CPC . *B67B 3/12* (2013.01); *B67B 3/14* (2013.01)

(58) Field of Classification Search
CPC .... B67B 3/12; B67B 7/16; B67B 7/00; B67B 3/14
See application file for complete search history.

(56) References Cited

U.S. PATENT DOCUMENTS 743,251 A 11/1903 Coomber
1,240,657 A * 9/1917 Bolick ..... B67B 7/16 81/3.27
1,362,776 A * 12/1920 Bunker ..... B67B 3/14 53/365
1,646,504 A * 10/1927 Swan ..... B67B 3/10 53/351
1,669,200 A * 5/1928 Hill ..... B67B 3/10 53/132.1
1,931,943 A 10/1933 Weaver et al.

FOREIGN PATENT DOCUMENTS

IT 1425893 6/2016

OTHER PUBLICATIONS

Italian Search Report dated Oct. 16, 2019 from counterpart Italian App No. IT 201800011020.
European Office Action dated Apr. 2, 2020 from counterpart European Patent Application No. 19215301.

* cited by examiner

*Primary Examiner* — Andrew M Tecco
*Assistant Examiner* — Nicholas E Igbokwe
(74) *Attorney, Agent, or Firm* — Shuttleworth & Ingersoll, PLC; Timothy J. Klima

(57) ABSTRACT

A manual capper for crown caps, of the type including a main support, two jaws, arranged symmetrically to the main support, each including a lower portion configured to encircle the neck of the bottle to be capped and an upper portion connectable to handlebars of the lever type, the actuation of which generates the opening and/or closure of the jaws, said capper wherein an actuation thereof in opening and/or in closure induces at least one simultaneous and linear displacement of the upper portion and of a portion of the handlebars, and wherein after the closure of the jaws, means suitable to keep the lower portion movable in a direction parallel to the vertical capping axis operate.

19 Claims, 7 Drawing Sheets

MANUAL CAPPER WITH TWO LEVER FOR CROWN CAPS

This application claims priority to Italian Patent Application IT102018000011020 filed Dec. 12, 2018, the entirety of which is incorporated by reference herein.

FIELD OF APPLICATION OF THE INVENTION

The present invention relates to the field of capper machines having at least two levers for crown caps.

Equipment is already known for the manual closure of crown caps on the mouth of bottles.

A head descends with the cap onto the bottle to be capped and an appropriately conformed bushing is clamped around the edge, bending the teeth of the cap that thus remains anchored to the bottle.

The manual machines are grasped with both hands on their handlebars and, if actuated, cause the closure of the jaws adapted to close around the neck of the bottle moving it closer to the cap.

A known type of capper envisages the handlebars being connected to a central bridge and to the main support by means of a series of connecting rods connected to one another by means of rotation hinges.

There may be a return spring that causes the closure of the jaws upon the release of the handlebars.

The drawbacks of current machines are:

Generation over time of play between the crank mechanism defined by the handlebars and the connecting rods, as well as by the bridge and the jaws.

Non uniform capping pressure.

Complex and expensive construction, both due to the components in question and their connection systems.

A further type of capper that solves the aforementioned problems in part is the one described in document IT1425893.

Said document describes a capper wherein the actuation in opening and/or closure thereof induces at least a simultaneous and linear displacement of the upper portion of the jaws and of a portion of the handlebars that is connected to the jaw.

This solution with respect to the previous one allows connecting rods and return springs to be eliminated, simplifying the construction, and reducing assembly times and costs, as well as reducing in part the play between the handlebars and the jaws.

However, the play on the jaws at the time of clamping around the neck remains present, hence limiting the efficiency of the capper.

Said play is added to the deformations of the jaw subject to compression forces in the contact area with the bottle neck and significant bending moment due to a high arm generated by the distance between said contact area and sliding elements between the jaw and the main support.

This also leads to a lack of precision and of uniform pressure.

A further consequence of this is the reduction in ability of the capper to adapt to different necks, in particular to different ranges of rings.

EXPOSURE AND ADVANTAGES OF THE INVENTION

The technical problem at the basis of the present invention is that of providing a device for capping bottles using crown caps that is structurally and functionally designed to overcome one or more of the limits set out above with reference to the prior art.

Within the scope of the aforesaid problem a main aim of the invention is that of developing a manual capper for capping bottles with crown caps that allows the reduction of play and uncontrolled deformation of the jaws in order to obtain maximum uniformity of capping pressure.

A further aim of the invention is also that of providing a manual capper for capping bottles with crown caps, within the scope of a simple and rational solution aimed to reduce assembly times and costs.

These and other objects are reached by the characteristics of the invention as set forth in the independent claims. The dependent claims outline preferred and/or particularly advantageous aspects of the invention.

In particular, an embodiment of the present invention provides a manual capper for crown caps, comprising a main support, two jaws, arranged symmetrically to the main support, each comprising a lower portion configured to embrace the neck of the bottle to be capped and an upper portion that can be connected to lever handlebars, the actuation of which generates the opening and/or closure of the jaws.

Said capper wherein an actuation thereof in opening and/or in closure induces at least a simultaneous and linear displacement of the upper portion of the jaws and of a portion of the handlebars and wherein after the closure of the jaws, means suitable to keep the lower portion of the jaws movable in a direction parallel to the vertical capping axis operate.

Thanks to this solution the jaw and in particular the lower portion thereof tends not to open because of the play that is very low, or due to strain because of being held in the guide also in the most strained part.

In particular, according to an aspect of the invention, the jaws are configured to be operatively associated with the main support and carry in the lower portion guide means configured to cooperate with corresponding counter-guide means of the main support, preventing the rotation or deformation or opening of the lower portion.

Thanks to this solution, the arm on which the force exercised in the contact of the jaw with the neck of the bottle is reduced.

Said arm is no longer provided by the distance between the contact area between the jaw with the neck and sliding pawls placed on the upper portion of the jaw, but by the distance between the contact area with the neck and the guide means placed on the lower portion of the jaw and therefore notably lower.

According to one embodiment each jaw comprises a pair of side flanges that flank the main support and are connected, in the lower portion, by a connecting member that remains located below the main support.

An advantage of the invention comes from the fact that the opening/closure of the jaws takes place by the rotation of the upper portion of the jaws and of the portion of the handlebars around the pins adapted to connect them, said pins being slidable in linear grooves of the main support and arranged parallel to the vertical capping axis of the capper.

Furthermore, the main support preferably comprises tracks that receive a series of lower pawls of the jaws, and each track has a portion that is inclined with respect to the capping axis, adapted to produce the opening or closure of the lower portion of the jaw and the rotation of the upper portion about the pins and carries a rectilinear portion parallel to the capping axis, which is suitable to produce the vertical capping movement of the closed jaw.

Thanks to this solution, the capper has reduced play and reduced construction and assembly complexity.

A preferred embodiment envisages that the guide means are located below the lower pawls and preferably in a position such as to cooperate with the counter-guide means when the lower pawls of the jaws are located in the rectilinear portion of the tracks.

Thanks to this solution, the jaws are guided throughout the entire vertical lifting section that follows the closure of the capper, i.e. during the actual capping step.

An aspect of the invention envisages that the guide means are arranged on an inner face of the side flanges and the counter-guide means are obtained on an outer face of the main support.

A possible embodiment comprises guide means shaped like a protrusion obtained on at least one of the side flanges of the jaw to which a respective recess of the counter-guide means corresponds.

Said solution allows the desired result to be obtained without adding any further pieces that would make the mounting of the capper more complex.

Preferably, the guide means extend from the side flange up to the connecting member of the jaws.

Thanks to this solution said guide means therefore define a rib that connects the side flange with the connection member thus also producing the effect of greater mechanical resistance of the jaw.

A further aspect of the invention envisages that the connecting member of the jaws comprises a seat configured to receive and hold a crescent-shaped element suitable to encircle the neck of the bottle where said crescent-shaped element comprises a securing member to be inserted preferably by snap-fit in the seat and an upper surface configured to contact the ring of the neck.

In particular, said upper surface extends downwardly in the capping direction by a protrusion comprising a first surface so shaped as to cooperate with the neck and a second surface to cooperate with the connecting member.

Thanks to this solution, it is possible to encircle the neck better and at the same time reinforce the crescent-shaped element also allowing it to be made of plastic.

Being made out of plastic makes it more adaptable and reliable on the neck, without damaging it and still maintaining the necessary mechanical resistance for capping.

A further concept that the invention comprises is the aim of increasing the capping flexibility and reliability.

In fact, said capper envisages that when the closure step has finished, i.e. when the jaws start the vertical translation, the position of the upper surface of the crescent-shaped element with respect to the bushing is such that the inner surface of the crown cap housed in the bushing is at a distance from the upper surface of crescent-shaped elements which is substantially equal to the height between the ring and the mouth of the bottle.

In the case in which the capper is provided for capping different bottles having different necks, in particular having different heights between the ring and the mouth that can fall within a range, said position of the upper surface of the crescent-shaped element with respect to the bushing will be such for which the inner surface of the crown cap housed in the bushing is at a greater distance from the upper surface of the crescent-shaped elements preferably equal to the average value of the heights between the ring and the mouth found in said range.

In this way, it is possible to safely cap without damaging the neck of the bottle or the cap also working with bottles of non-constant dimensions.

Said objects and advantages are all obtained by the capper, according to the present invention, which is characterised according to the following claims.

BRIEF DESCRIPTION OF THE DRAWINGS

This and other features will be more apparent from the following description of some of the embodiments, illustrated purely by way of non-limiting example in the accompanying drawings.

DESCRIPTION OF THE INVENTION

Figure 1:
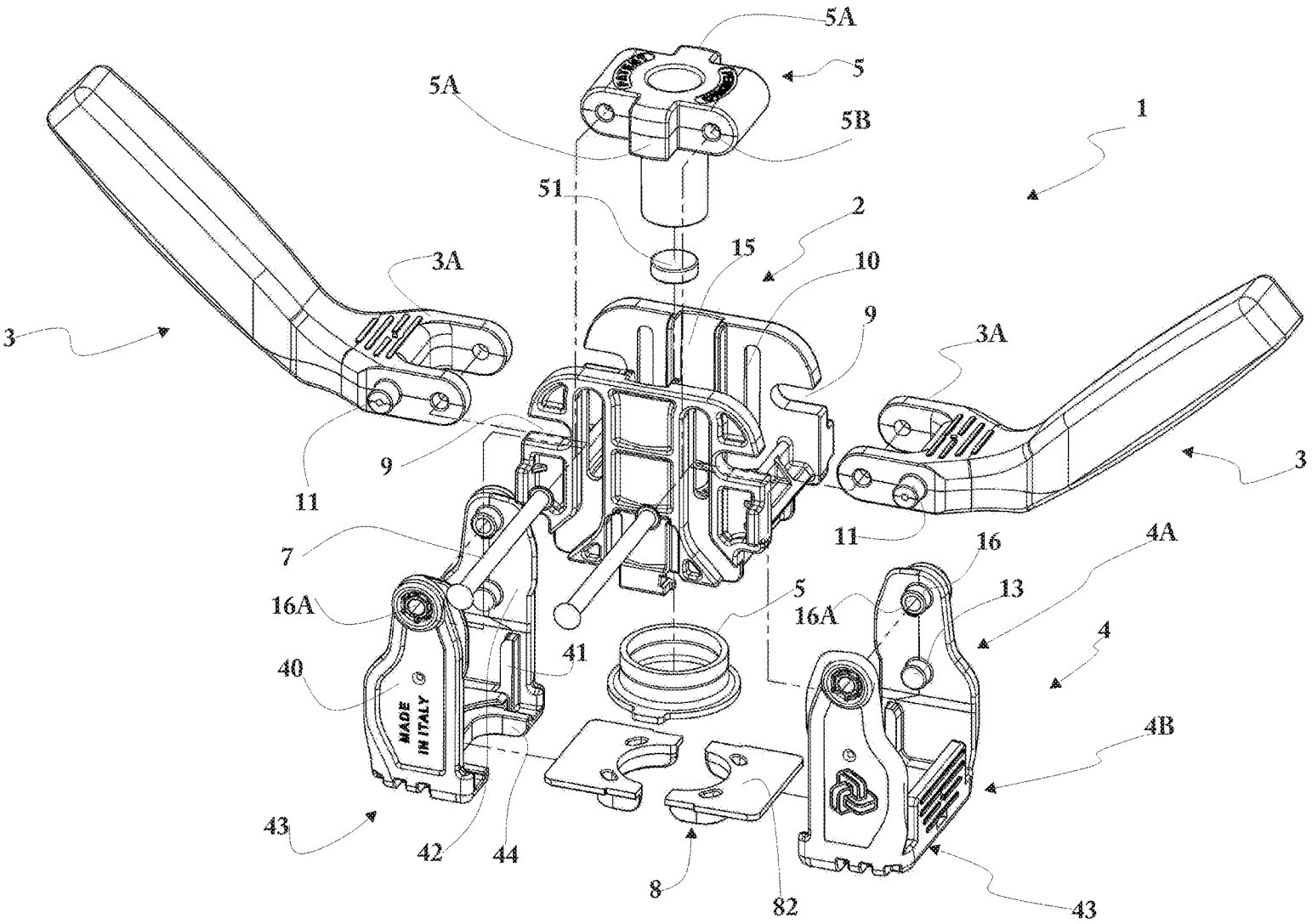
FIG. 1: illustrates the exploded configuration of the components that contribute to forming the capper according to the present invention.

With particular reference to FIG. 1 an exploded view of the manual capper 1 is illustrated for crown caps 105, according to the invention.

The capper is indicated overall by reference number 1.

The capper 1 is formed by the assembly of some components that are engaged with a bridge element or main support, indicated with reference number 2; said bridge being appropriately conformed to house the components in question, as will be described better below.

Specifically, a preferred embodiment envisages that said components are housed in appropriate sliding guides of said bridge or main support 2, in particular:

- two handlebars 3 of the lever type
- two jaws 4, one per handlebar; anchored to said jaws are crescent-shaped elements 8 having the function of encircling the neck 101 of the bottle 100 to be capped, The two jaws 4 are preferably arranged symmetrically on the bridge element 2 with respect to a plane passing through a capping axis AA with reference to a bottle 100 to be capped arranged vertically on a support plane, said axis AA therefore preferably being vertical and at the centre of the capper 1.

According to an aspect of the invention, the capper further comprises:

- a head 5, preferably also known as a magnet holding element, as it can be configured to withhold the crown cap 105 preferably by means of a magnet 51 incorporated into said head 5.
- a contrast bushing 6 adapted to house and bend the edge of the crown cap 105, following the activation of the capper 1.

The bushing 6 is placed inside the bridge 2 and integral therewith, whereas the head 5 is coaxial with the bushing 6 and axially slidable along the main support 2 according to the axis AA, as the figures indicate. Said head 5 is configured to act as an ejector during the opening and to allow the detachment of the crown cap 105 from the bushing 6.

The two lever handlebars 3, the related jaws 4 and the head 5 are all connected to one another by means of a single element such as the pair of pivots or pins 7.

Each pivot and/or pin 7 acts as a hinge for the jaws 4, of the lever handlebars 3 and of the head 5 and is arranged perpendicular to the axis AA of the capping machine 1 in question.

The aim of the bushing 6 (housed in the support 2) is that of bending, as has been known for some time, the toothed edge of the crown cap 105, following the closure of the jaws 4 and therefore the lifting of the head 5 upwards, as the sequence of the appended figures indicates.

According to a preferred embodiment, an opening and/or closure action of the capper 1, i.e. from a non-operating position to an operating position and/or vice versa, is performed by acting on the lever handlebars 3.

In particular, at least one simultaneous and linear displacement of at least one upper portion 4A of the jaws 4 and a portion 3A of the lever handlebars is induced.

Said displacement is preferably performed by means of a series of linear grooves 10 obtained in the bridge 2 configured to cooperate with the pins 7.

Figure 5:
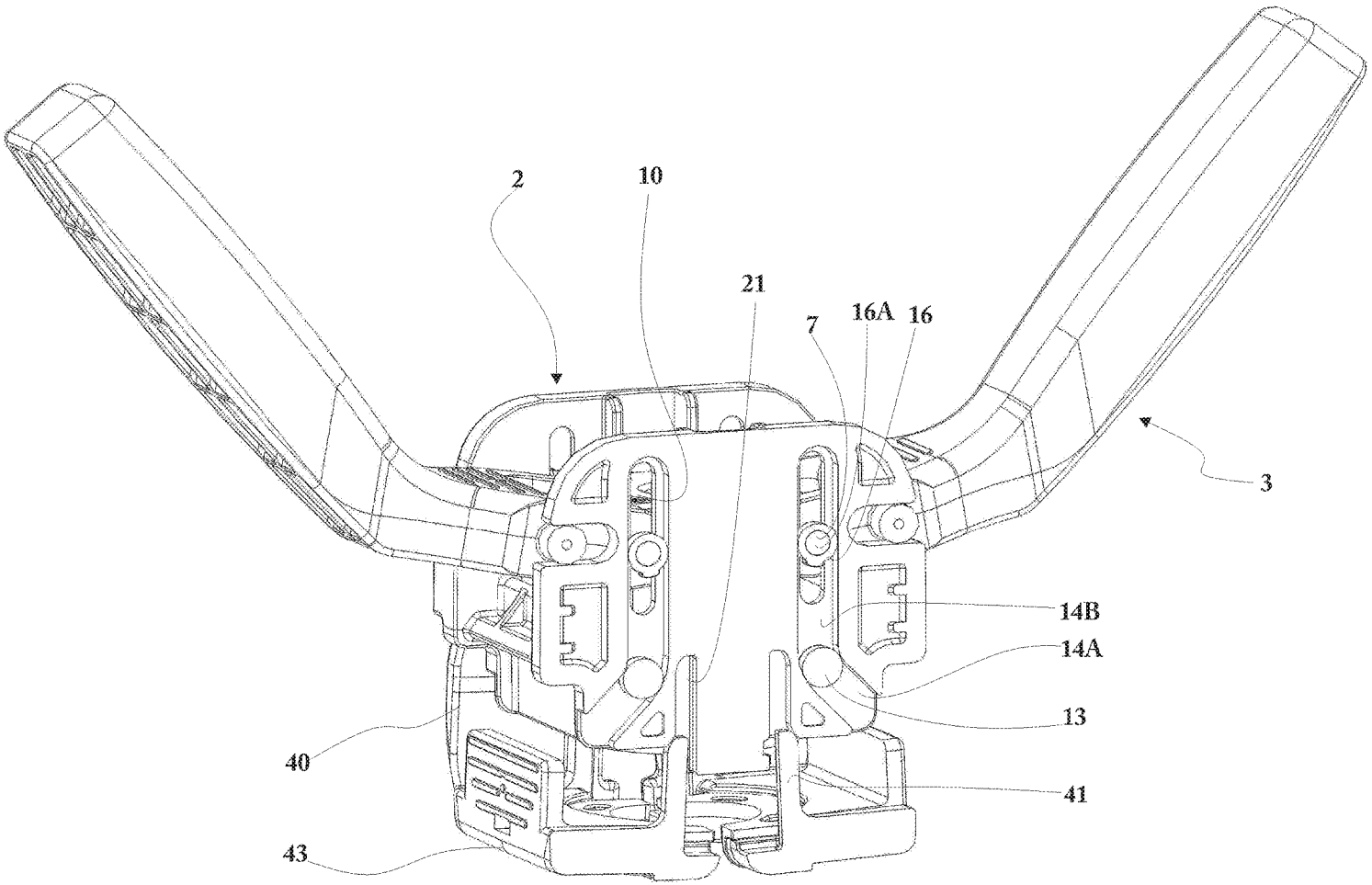
Figure 6:
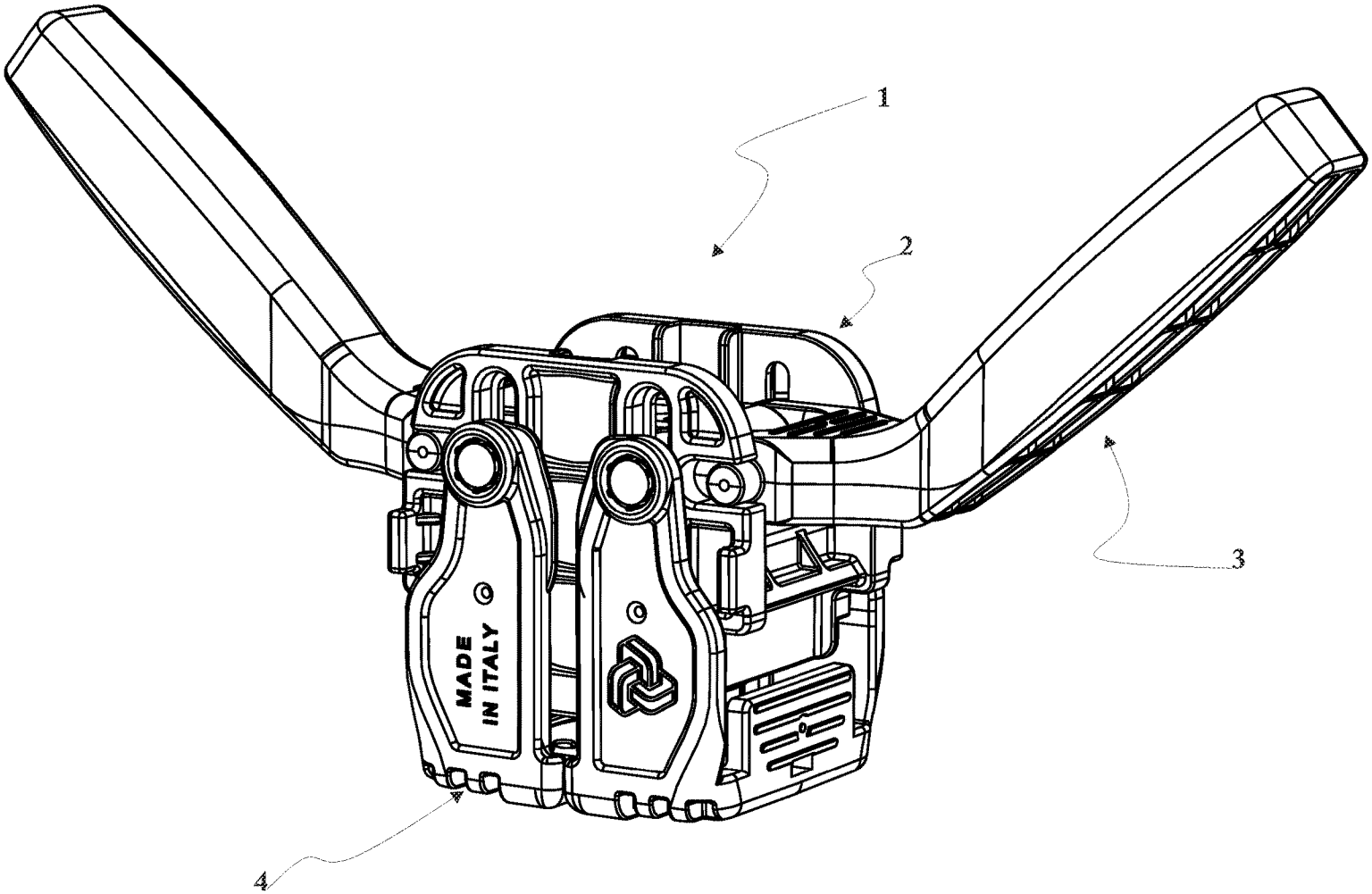
Figure 7:
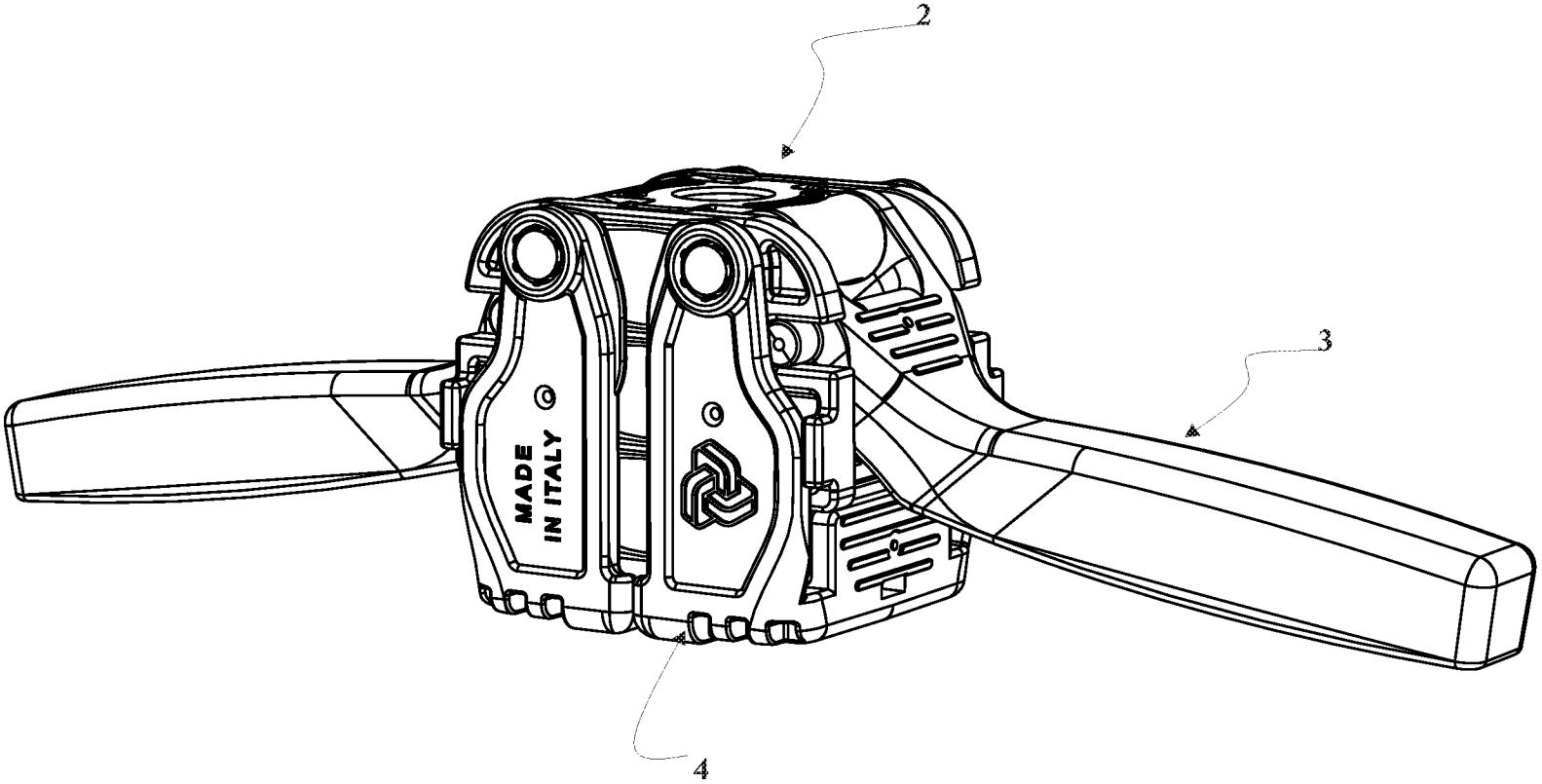

Said grooves 10 as represented in FIG. 5, can also be through openings, e.g. crossed by said pins 7, which in turn support the elements 3, 4, 5.

More precisely, as shown in FIG. 1, said displacement along the groove 10 is performed by the portions 3A and 4A, respectively of the lever handlebars 3 and jaws 4, withheld by pivots or pins 7 that are inserted into coaxial holes 12 obtained on the portion 3A and holes 16B of the upper portions 4A.

A further aspect of the invention envisages that as represented in FIG. 5, the main support 2 comprises tracks 14 configured to house lower pawls 13 obtained on the jaws 4.

In a preferred embodiment, each track 14 has a portion 14A that is inclined with respect to the capping axis AA, adapted to produce the opening or closure of the lower portion 4B of the jaw 4 and the rotation of the upper portion 4A about the pins 7; it further carries a rectilinear portion 14B parallel to the capping axis AA, which is suitable to produce the vertical capping movement of the closed jaw 4.

Said rectilinear portions 14B of the tracks 14 are preferably obtained along the same path as the grooves 10.

Thanks to this configuration, during the activation of the capper 1 a first closure step is established which envisages:

a. On the jaws 4, a further actuation of the lower portion indicated with 4B, which takes place by creating a rotation with the hinge point identifiable in the same upper portion 4A that runs linearly along the groove 10 preferably at the pins 7; said activation of the lower portion 4B is performed through the lower pawls 13 of the jaws 4 that project towards the inside of the bridge 2, being inserted into the tracks 14 and in particular in the inclined portion 14A thereof.

b. On the lever handlebars 3, a further linear displacement relative to the main support 2; said linear displacement of the portion 3A takes place by means of a series of grooves and/or openings 9 obtained in the support 2 and arranged perpendicular to the linear sliding groove 10. In said grooves/openings 9 the portions 3A of said lever handlebars 3 run by means of the relative engagement elements indicated with the reference numbers 11. It follows that the rotation of the lever handlebars 3 will be the result of two contemporary displacements, one of which is linear, along the vertical direction parallel to the axis AA, the other perpendicular, i.e. towards a direction away from the central axis AA of the capper 1.

Furthermore, during the actuation of the capper 1 a second lifting step is established for performing the capping following closure, which envisages:

a. On the jaws 4, a further actuation of the lower portion 4B, which takes place by creating a lifting in the vertical direction parallel to the axis AA, identifiable in the same upper portion 4A that runs linearly along the groove; said actuation of the lower portion 4B is performed by means of the lower pawls 13 which are inserted into the rectilinear portion 14B parallel to the axis AA of the tracks 14 obtained on the main body 2.

b. On lever handlebars 3, a further linear displacement relative to the main support 2; said linear displacement of the portion 3A takes place, by the sliding of the engagement elements 11 in the grooves and/or openings 9.

The rotation of the lever handlebars 3 will be the result of two displacements, one of which is linear, along the vertical direction parallel to the axis AA, the other perpendicular, i.e. in a direction towards the central axis AA of the capper 1.

In both of said steps, the head 5 also follows a linear displacement, being constrained with the other elements in the same hinge point defined by the pins 7. The pins 7 are inserted (in an assembled configuration) into relative holes 5B.

The head 5 preferably has projections 5A adapted to be engaged in relative vertical sliding guides 15 obtained on the inner portion of the main support 2.

In other words, the capper 1 is defined by the main support 2 conformed so as to arrange the sliding of the moving components in relative tracks or grooves or linear openings 9, 10, 14, so that the combination of the possible displacements causes:

The closure or opening of the jaws 4 on the neck 101 of the bottles 100, The ascent or descent of the element 5, with any ejection of the bottle 100 still by the element 5.

Said movements are obtained by linear slidings, one of said slidings being in common with elements 3, 4, 5.

With regard to the movement of the lever handlebars 3; they allow a lever of a first kind to be operated; for that purpose the rotation/hinging axis is perpendicular to the axis of the capper 1 and arranged adjacent, i.e. within the central bridge 2; this is performed by maintaining the rotation on the pivot/pin 7, which is located perpendicular to the axis of the capper 1 and free to slide in the vertical linear grooves 10, grooves 10 which are housed inside the bridge 2 itself.

The further grooves and/or openings and/or tracks 9 and 14, are obtained in the bridge 2 with the purpose of generating slidings for the further portions of the jaws 4 and the lever handlebars 3 during the capping and/or return actuation.

As mentioned, the jaws 4 slide in tracks 14 of the bridge 2 through a series of lower pawls 13 which are projected inwards thus engaging in the tracks 14 that comprise an inclined portion 14B arranged inclined towards the outside (with reference to the central axis AA of the apparatus 1); the aim of said inclination is that of producing, in combination with the linear ascent or descent movement, a rotation of the jaw 4 in opening or closure on the neck 101.

Possibly, as can be observed from the figures, a further series of upper pawls 16 can be engaged in the rectilinear portions 14A of the tracks 14, rectilinear portions that are obtained along the same path as the grooves 10 within which the pins 7 run; the aim of said second series of upper pawls 16 is that of stabilizing better the linear sliding, reducing possible play between the assembled elements.

The subject matter of the invention improves the characteristics of a capper 1 of the type described. In fact, even if the second series of upper pawls 16 has the aim of stabilizing the linear sliding, two problems remain clear:

- the significant play between assembled elements that are reflected on the lower portion 4B of the jaw 4 that affect the work precision;
- the high bending moment that is discharged on the lower pawls 13 due to the combination between a significant force present in the contact area of the jaw 4 with the neck 101 and the high arm provided by the distance between said contact area and the lower pawls 13.

In fact, the effort exercised by the contact between the jaw 4 and the neck 101 of the bottles 100, tends to make said lower portion 4B be deformed, therefore when the capper 1 is closed for capping, the effect of the play is added to the strain on the pawls 13 and 16 generating the opening of the jaws 4 and imprecise work.

To overcome said drawbacks, an aspect of the invention envisages that during the simultaneous and linear displacement of the upper portion 4A and of the portion 3A of the handlebars 3 and after the closure of the jaws 4, means suitable to keep the lower portion 4B movable in a direction parallel to the vertical capping axis AA operate.

Thanks to this solution the jaw 4 and in particular the lower portion 4B thereof tends not to open because of play or due to strain because of being held in the guide also in the most strained part.

In particular, according to an aspect of the invention, the jaws 4 are configured to be operatively associated with the main support 2 and preferably have below the lower pawls 13, in the lower portion 4B, guide means 41 configured to cooperate with corresponding counter-guide means 21 of the main support 2 preventing the rotation or deformation or opening of the lower portion 4B.

Thanks to this solution, the arm on which the force exercised in the contact of the jaw 4 with the neck 101 is reduced.

Said arm is no longer provided by the distance between the contact area of the jaw 4 with the neck 101 and the lower pawls 13, but by the distance between the contact area with the neck 101 and the guide means 41 and therefore notably lower.

Each jaw 4 preferably comprises a pair of side flanges 40 that flank the main support 2 and are connected, in the lower portion 4B, by means of a connecting member 43 that remains positioned below the main support 2.

A preferred embodiment, represented in FIG. 5, envisages that the guide means 41 are located below the lower pawls 13 and preferably in a position such as to cooperate with the counter-guide means 21 when the lower pawls 13 of the jaws 4 are located in the rectilinear portion 14B of the tracks 14.

Thanks to this solution, the jaws 4 are guided throughout the entire vertical lifting section that follows the closure of the capper 1, i.e. during the actual capping step.

An aspect of the invention represented in FIG. 1 envisages that the guide means 41 are arranged on an inner face 42 of the side flanges 40 and the counter-guide means 21 are obtained on an outer face 22 of the main support 2.

Figure 2:
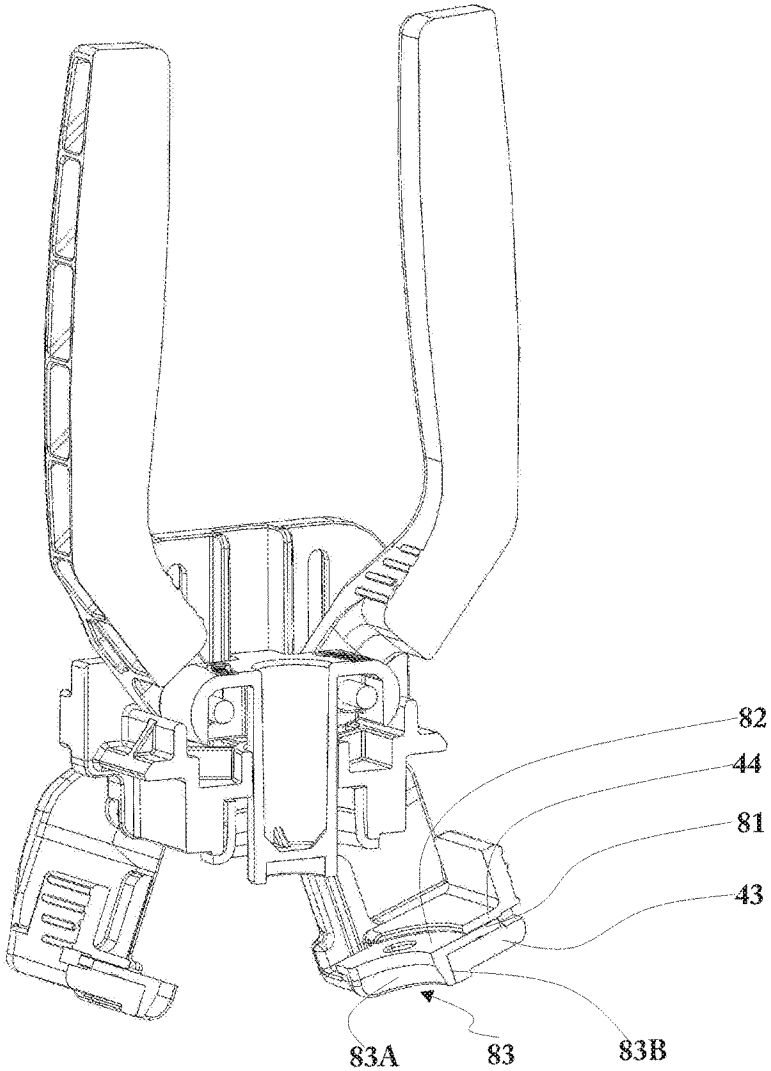
FIG. 2: illustrates the sectional configuration of the assembled capper.
Figure 3:
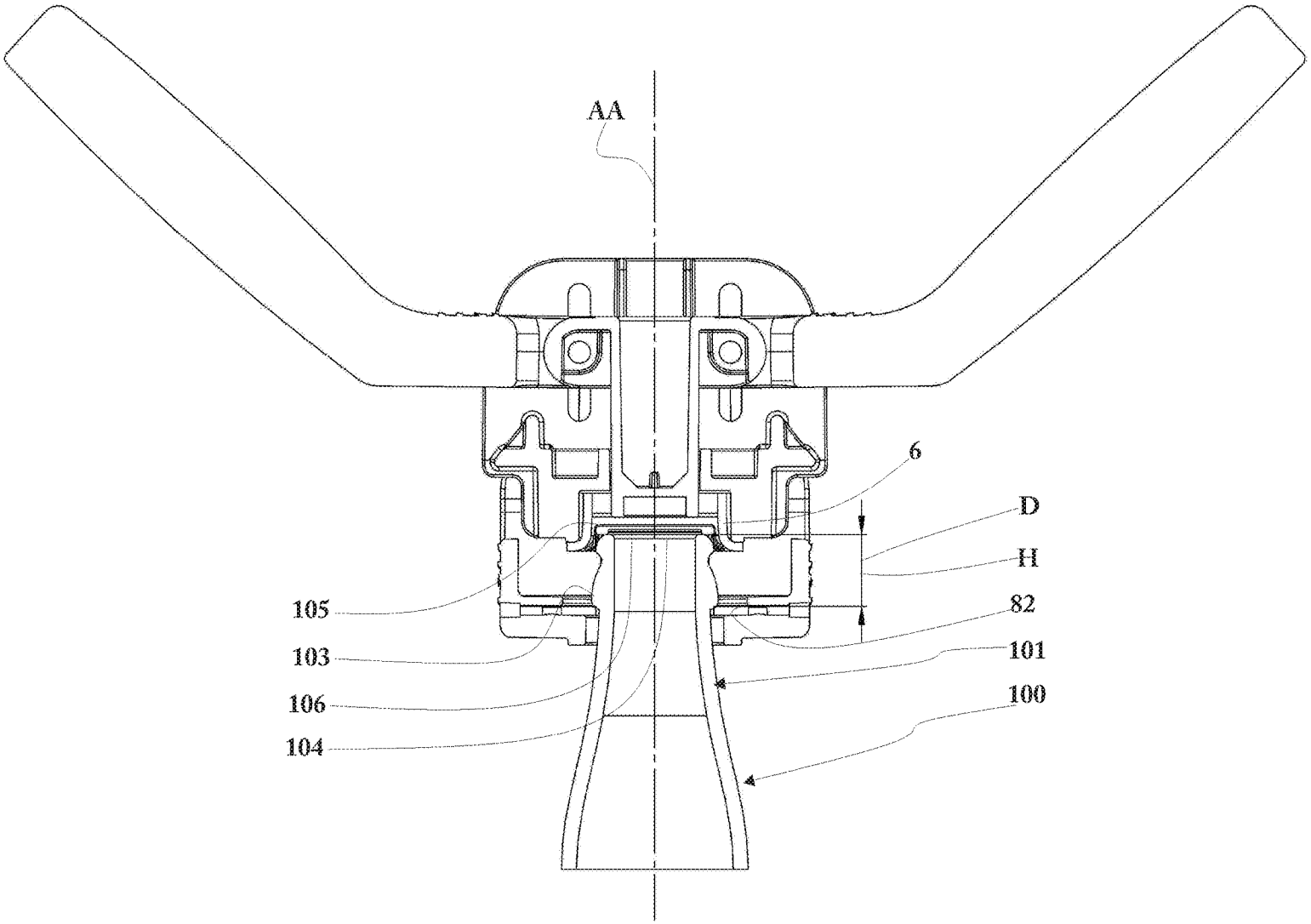
FIG. 3: illustrates the sectional configuration of the capper with bottle.
Figure 4:
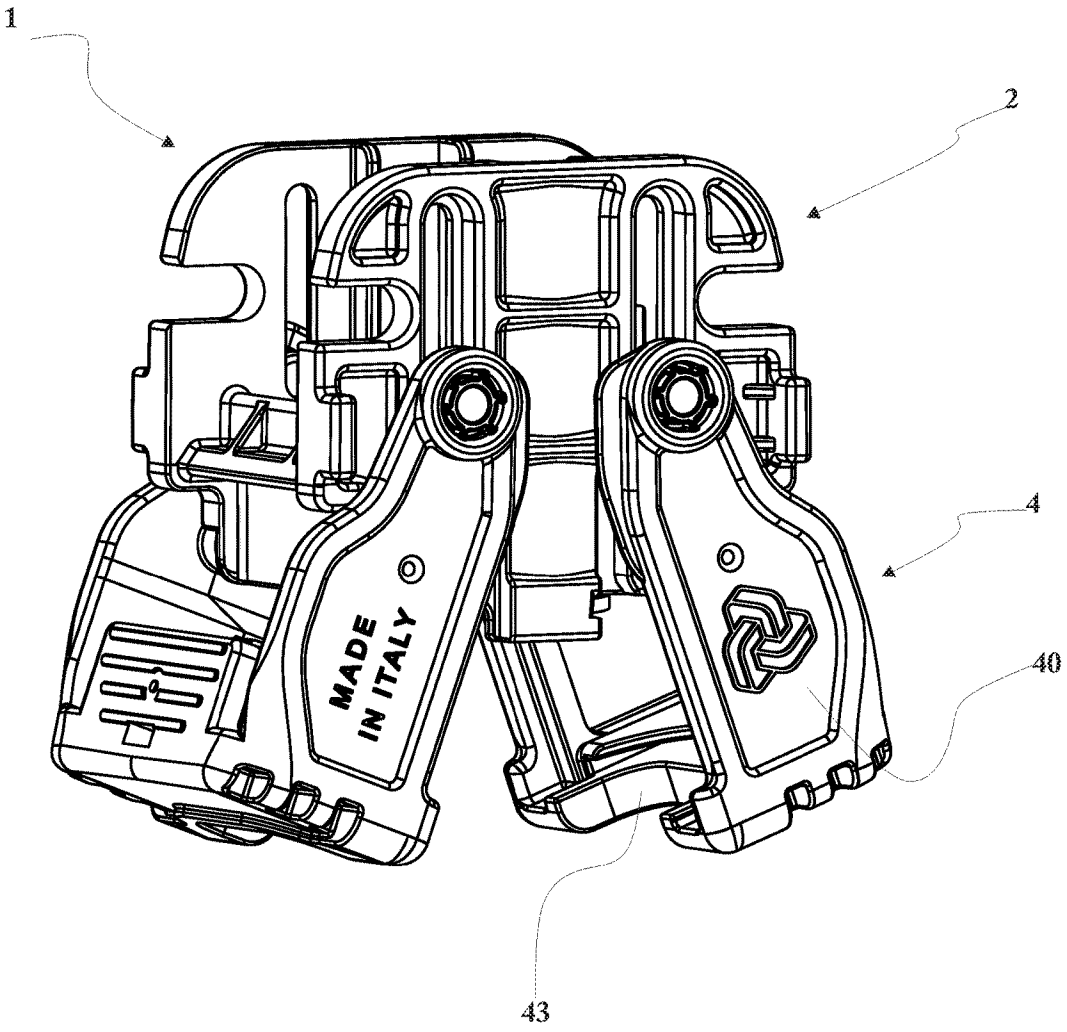
FIGS. 4, 5, 6, 7: illustrate the capper assembled and in the different operating configurations thereof, from open to closed.

A possible embodiment represented in FIGS. 1, 2 and 5, comprises guide means 41 shaped like a protrusion obtained on at least one of the side flanges 40 of the jaw 4 to which a respective recess of the counter-guide means 21 corresponds.

Said solution allows the desired result to be obtained without adding any further pieces that would make the mounting of the capper 1 more complex.

Preferably, the guide means 41 extend from the side flange 40 up to the connecting member 43 of the jaws 4.

Thanks to this solution said guide means 41 therefore define a rib that connects the side flange 40 with the connection member 43 thus also producing the effect of greater mechanical resistance of the jaw 4.

Furthermore, the counter-guide means 21 can project to the lower end of the main support 2 defining an open recess adapted to receive the guide means 41 only in the vertical lifting step of the closed jaws 4.

As portrayed in the drawings, the counter-guide means 21 are preferably arranged on the main support 2 in a more internal position with respect to the tracks 14.

A further aspect of the invention envisages that the connecting member 43 of the jaws 4 comprises a seat 44 configured to receive and hold a crescent-shaped element 8 suitable to encircle the neck 101 of the bottle 100 where said crescent-shaped element 8 comprises a securing member 81 to be inserted preferably by snap-fit in the seat 44 and an upper surface 82 configured to contact a ring 103 of the neck 101.

The term ring 103 means to a person skilled in the art the protuberance present on the neck placed below the mouth 104 of the bottle 100 and predisposed for capping with a crown cap 105.

In particular, said upper surface 82 extends downwards in the capping direction by means of a protrusion 83 comprising a first surface 83A shaped to cooperate with the neck 101 and a second surface 83B to cooperate with the connection element 43.

The protrusion 83 enables the neck 101 to be encircled better and the crescent-shaped element 8 to be reinforced allowing it to be also made of plastic.

Being made out of plastic makes it more adaptable and reliable on the neck 101 with respect to a steel crescent-shaped element; the plastic crescent-shaped element 101 does not damage the neck 101 while still maintaining the necessary mechanical resistance for capping.

As previously described, the capper 1 comprises the bushing 6 integral with the main support 2 configured to bend the toothed edge of the crown cap 105.

A further concept that the invention comprises in order to increase the capping flexibility and reliability comes from the fact that said capper 1 envisages that at the end of the closure step, i.e. when the lower pawls 13 of the jaws 4 enter the rectilinear portion 14B of the tracks 14, the position of the upper surface 82 of the crescent-shaped elements 8 with respect to the bushing 6 is such that the inner surface 106 of the crown cap 105 housed in the bushing 6 is at a distance D from the upper surface 82, which is substantially equal to the height H between the ring 103 and a mouth 104 of the neck 101.

In the case in which the capper 1 is provided for capping different bottles 100 having different necks 101, in particular having different heights H between the ring 103 and the mouth 104 that can be found within a range, said distance D will preferably be equal to the average value of heights H found within said range.

In particular, the distance D between the inner surface 106 of the crown cap 105 housed in the bushing 6 and the upper surface 82 is preferably comprised between 15 and 19 millimetres.

A further preferred configuration envisages the distance D being equal to 17 millimetres.

These values are the ones identified for maximizing the work flexibility of the capper 1 allowing safe capping, i.e. without damaging the neck of the bottle or the cap, also working with bottles with non-constant sizes between the ring 103 and the mouth 104.

The closure and opening movements of the apparatus 1 represented in FIGS. 4 to 7 are summarized below.

Considering that the bushing 6 is firmly anchored to the bridge 2 and the crescent-shaped elements 8 are firmly anchored to the jaws 4, and that the initial configuration is that of FIG. 2, wherein the handlebars 3 are vertical upwards, the jaws 4 are open and inclined downwards and the head 5 is in its maximum lower position, after resting a cap on the head 5 and positioning the capper 1 on the bottle 100, the capping step is performed, with a closure movement.

Closure Movement:

Turn the ends of the handlebars 3 downwards:

the pivots 11 of the handlebars 3 run horizontally on the guides 9 of the bridge 2 the portions 3A of the handlebars 3 move upwards the holes 12 obtained on the portions 3A pull the pins 7 in their upwards movement the pins 7 guided by the grooves 10 obtained on the bridge 2 perform a vertical rectilinear movement upwards.

in their translation the pins 7 pull the jaws 4 through the holes preferably obtained in the upper pawls 16.

the jaws 4 perform a roto-translation due to the displacement of the pawls 13 and 16 induced by the track 14 obtained on the bridge 2, in particular the upper pawls 16 translate vertically upwards and the lower pawls 13 perform a rotation, the combined movement makes the jaws 4 close around the neck of the bottle 100 bringing the crescent-shaped elements 8 into contact with the bottle 100 itself and positioning them below the ring 103 of the bottle 100.

the head 5, also engaged by the pins 7 in the holes 5B, translates vertically upwards, disengaging the cap 105 and leaving it the possibility to penetrate into the bushing 6.

after completing the roto-translation step, the jaws 4 continue their movement exclusively by means of a vertical translation upwards, thanks to the rectilinear portion of track 14 that engages both the pawls 13 and 16 only in the translation and that engages the guide means 41 of the jaw 4 in the counter-guide means 21 of the main support 2;

the jaws 4 pull the bottle 100 forcing it below the ring 103 by means of the crescent-shaped elements 8 making it translate vertically upwards the cap 105 fitted onto the bottle 100 is thus forced to penetrate into the bushing 6 deforming its outer crown to close onto the lip of the bottle 100.

Opening Movement:

Rotate the ends of the handlebars 3 upwards the pivots 11 of the handlebars 3 run horizontally on the guides 9 of the bridge 2 the portions 3A of the handlebars 3 move downwards the holes 12 obtained on the portions 3A pull the pins 7 in their downwards movement the pins 7 guided by the grooves 10 obtained on the bridge 2 perform a vertical rectilinear movement downwards.

in their translation the pins 7 pull the jaws 4 through the holes preferably obtained in the upper pawls 16.

the jaws 4 perform their movement exclusively by means of a vertical translation downwards, thanks to the rectilinear portion of guide 14 that engages both the pawls 13 and 16 only in the translation and that engages the guide means 41 of the jaw 4 in the counter-guide means 21 of the main support 2;

the jaws 4 translate downwards disengaging the crescent-shaped elements 8 from the contact with the ring 104 of the bottle 100 in fact also allowing it to move downwards.

after completing the translation step, the jaws 4 perform a roto-translation due to the displacement of the pawls 13 and 16 induced by the guide 14 obtained on the bridge 2, in particular the upper pawls 16 translate vertically downwards and the lower pawls 13 perform a rotation the combined movement makes the jaws 4 open around the neck 101 of the bottle 100 bringing the crescent-shaped elements 8 downwards, externally distant from the bottle 100 itself.

the head 5, also engaged by the pins 7 in the holes 5B, translates vertically downwards until coming into contact with the cap contained in the bushing 6.

finally, continuing its stroke, the head 5 pushes the cap 105 outside the bushing 6 in fact releasing it together with the bottle 100.

The invention claimed is:

1. A manual capper for crown caps, comprising a. a main support having a vertical capping axis, b. two jaws, arranged symmetrically to the main support, each comprising a lower portion configured to encircle a neck of a bottle to be capped, an upper portion and a lower pawl, c. handlebar levers, the actuation of which generates an opening and/or closure of the jaws, the handlebar levers including connecting portions connected to the upper portions of the jaws, the capper being configured such that an actuation of the handlebar levers in the opening and/or closure induces at least one simultaneous and linear displacement of both the upper portions of the jaws and of the connecting portions of the handlebar levers, a guide mechanism suitable to keep the lower portions movable in a direction parallel to the vertical capping axis after the closure of the jaws around the neck of the bottle, the guide mechanism including at least one guide protrusion, wherein the at least one guide protrusion is positioned below the lower pawls.

2. The capper according to claim 1, wherein:

the jaws are configured to be operatively connected to the main support, the at least one guide protrusion includes two guide protrusions respectively connected to the lower portions, and the main support includes counter-guide recesses configured to engage the guide protrusions respectively to prevent rotation or deformation of the lower portions.

3. The capper according to claim 2, and further comprising a connecting member, wherein the jaws comprise a pair of side flanges that are located side-by-side to the main support and are connected, in the lower portion, by the connecting member that remains located below the main support.

4. The capper according to claim 3, wherein the guide protrusions are arranged on inner faces of the side flanges and the counter-guide recesses are positioned on outer faces of the main support.

5. The capper according to claim 3, wherein the guide protrusions extend from the side flanges of the jaws up to the connecting member of the jaws.

6. The capper according to claim 2, and further comprising pins connecting the upper portions and the connecting portions, wherein the main support includes linear grooves arranged parallel to the vertical capping axis of the capper for slidably receiving the pins, and wherein the opening and/or closure of the jaws occurs by rotation of the upper portions and the connecting portions about the pins.

7. The capper according to claim 6, wherein the main support comprises tracks that receive the lower pawls of the jaws, each track including a portion that is inclined with respect to the vertical capping axis, the tracks adapted to produce the opening and/or closure of the lower portions of the jaws and the rotation of the upper portions about the pins, each track also including a rectilinear portion parallel to the vertical capping axis, the rectilinear portions being suitable to produce a vertical capping movement of the closed jaws.

8. The capper according to claim 7, wherein the rectilinear portions of the tracks are positioned along same paths as the linear grooves.

9. The capper according to claim 7, wherein the guide protrusions engage the counter-guide recesses when the lower pawls of the jaws are located in the rectilinear portion of the tracks.

10. The capper according to claim 7, wherein the counter-guide recesses are arranged on the main support in an innermost position with respect to the tracks.

11. The capper according to claim 7, wherein the connecting member comprises a seat configured to receive and hold a crescent-shaped element suitable to encircle the neck of the bottle.

12. The capper according to claim 11, wherein the crescent-shaped element comprises a securing member to insert by snap-fit in the seat and an upper surface configured to contact a ring of the neck of the bottle.

13. The capper according to claim 12, wherein the upper surface extends downwardly in a capping direction by a protrusion comprising a first surface so shaped as to cooperate with the neck of the bottle and a second surface to cooperate with the connecting member.

14. The capper according to claim 11, wherein the crescent-shaped element is made of plastic material.

15. The capper according to claim 11, and further comprising a bushing integral to the main support configured to house and fold a finned edge of the crown cap.

16. The capper according claim 15, wherein when the lower pawls of the jaws are positioned in the rectilinear portions, a position of an upper surface of the crescent-shaped element with respect to the bushing is such that an inner surface of the crown cap housed in the bushing is at a distance from the upper surface, which is substantially equal to a height between a ring of the neck of the bottle and a mouth of the neck of the bottle and/or a predetermined height.

17. The capper according to claim 16 wherein the distance between the inner surface of the crown cap housed in the bushing and the upper surface ranges between 15 and 19 millimeters.

18. The capper according to claim 2, wherein the guide protrusions are positioned on the side flanges of the jaws to which the counter-guide recesses correspond.

19. The capper according to claim 2, wherein the counter-guide recesses extend up to a lower end of the main support defining an open recess.

* * * * *